United States Patent [19]

Grigg

[11] Patent Number: 5,012,539

[45] Date of Patent: May 7, 1991

[54] INFLATABLE MULTI-PURPOSE MEDICAL SUPPORT PILLOW

[76] Inventor: Ellen S. Grigg, 816 Dixie Ave., Florence, Ala. 35630

[21] Appl. No.: 479,169

[22] Filed: Feb. 13, 1990

[51] Int. Cl.[5] ..... A47C 20/00

[52] U.S. Cl. ..... 5/431; 5/441

[58] Field of Search ..... 5/441, 443, 434, 431, 5/436, 442, 449

[56] References Cited

U.S. PATENT DOCUMENTS

| | | | |
|---|---|---|---|
| 2,612,645 | 10/1952 | Boland | 5/441 |
| 3,574,397 | 4/1971 | Norriss . | |
| 3,644,949 | 2/1972 | Diamond | 5/441 |
| 3,680,917 | 8/1972 | Harris . | |
| 3,722,012 | 3/1973 | Tobinick et al. | 5/441 |
| 3,757,364 | 9/1973 | Downing . | |
| 4,142,263 | 3/1979 | Pierson | 5/441 X |
| 4,270,235 | 6/1981 | Gutmann . | |
| 4,320,543 | 3/1982 | Dixon . | |
| 4,349,925 | 9/1982 | Macomber . | |
| 4,501,034 | 2/1985 | Greenawalt . | |
| 4,635,306 | 1/1987 | Willey . | |
| 4,736,477 | 4/1988 | Moore . | |
| 4,756,090 | 7/1988 | Pedrow . | |
| 4,759,089 | 6/1988 | Fox | 5/434 |
| 4,779,296 | 10/1988 | Bond | 5/443 X |
| 4,805,603 | 2/1989 | Cumberland | 5/441 X |
| 4,850,067 | 7/1989 | Latorre . | |
| 4,899,406 | 2/1990 | Sanderson et al. | 5/449 |
| 4,928,336 | 5/1990 | Petillo, Sr. | 5/441 |
| 4,932,089 | 6/1990 | Laviero | 5/442 |

*Primary Examiner*—Gary L. Smith
*Assistant Examiner*—Michael J. Milano
*Attorney, Agent, or Firm*—Hugh D. Jaeger

[57] ABSTRACT

An inflatable multi-purpose medical support pillow for supporting a body member, or a portion of the body. One side of the pillow is deeply grooved to cradle an extremity, and the other side is slightly grooved for trunk support. The pillow is an inflatable triangle member including a body anchor member attached to the lower end of the pillow. A pillow slip can engage over the pillow.

9 Claims, 8 Drawing Sheets

INFLATABLE MULTI-PURPOSE MEDICAL SUPPORT PILLOW

BACKGROUND OF THE INVENTION

1. Field of the Invention

The present invention pertains to an inflatable multi-purpose medical support pillow, and more particularly, pertains to an inflatable medical support pillow with an angled V-shaped indentation in the center section of the pillow.

2. Description of the Prior Art

Prior art pillows are currently used to provide elevation for the body or members of the body; however, the pillows are bulky, uneven and continuously sliding out of place and often off the beds. This not only causes discomfort to the patient, but aggravation for the attending personnel, such as nurses. Many different pillows are needed to accommodate different body parts. Most pillows that would be suitable for the lumbar region, would not be suitable for an extremity, etc.

The present invention overcomes the disadvantages of the prior art by providing an inflatable medical support pillow which provides compact and even support, and is stationary in a bed or a resting place, such as a sofa or chair. This pillow is a multi-purpose pillow which replaces the need for many different pillows. By adjusting the location of the pillow, one can easily change the use of the pillow.

SUMMARY OF THE INVENTION

The general purpose of the present invention is to provide an inflatable multi-purpose medical support pillow which includes a body anchor member attached thereto.

According to one embodiment of the present invention there is provided an inflatable multi-purpose medical support pillow including a substantially flat base, a trapezoidal end, a trapezoidal top member with a groove extending substantially along a center portion thereof from top to bottom, and triangular sides.

Significant aspects and features of the present invention are an inflatable triangular pillow made of heavy duty vinyl. One side of the pillow is deeply grooved to cradle an extremity. The other side is slightly grooved making trunk support comfortable. The inflatable medical support pillow has a body anchor that fits under the body to secure the support. Approximately 15 inches at its highest point, 20–36 inches wide, and 30 inches long, the inflatable multi-purpose medical support pillow has a 12–18 inch body anchor.

Since the inflatable multi-purpose medical support pillow is inflatable, storage is easy, inflation is simple, and the vinyl can be wiped clean with a damp cloth. Being light weight and secured with the body anchor, the inflatable multi-purpose medical support pillow allows for patient adjustment without involving nurses.

The unit can be inflated with a household hair dryer, and can be sold as a disposable unit allowing the patient to enjoy the continued support at home after dismissal.

Other significant aspects and features of the present invention include that the inflatable support pillow is effective as an aid for hiatial hernia patients. It would comfortably elevate their upper body.

The inflatable multi-purpose medical support pillow might also be used to elevate an extremity that should not be wet when in Hubbard Tanks. Use of the inflatable multi-purpose medical support pillow can also be used to elevate the patients head while in the Hubbard tank to ease breathing.

When partially deflated, the inflatable multi-purpose medical support pillow could be used in knee flexion exercises. When used as a knee support in the Trendelenburg position, it will prevent hyperextension of the knee. The inflatable multi-purpose medical support pillow can be beneficial for ACL patients. Use of the inflatable multi-purpose medical support pillow can be used for wrist injury. As an arm rest, the inflatable medical support pillow can provide much needed support after a mastectomy.

Additional aspects and features of the inflatable multi-purpose medical support pillow to elevate and support a leg, bringing comfort to patients after leg or knee surgery of any kind. The pillow is used in patients having knee surgeries or injuries which require a certain degree of immobilization. The body anchor of the pillow for knee support is placed under the patient's hip and the elevated end extends under the treated leg. The leg is placed in the center of the groove. The pillow is easy to place and remove. Pillows are currently used to provide elevation. However, they are bulky, uneven, and continuously sliding out of place and off the beds. This not only causes discomfort to the patient, but aggravation for the nurses. The pillow provides compact and even support which would be stationary in the bed. This alleviates the discomfort for patients and aggravation for nurses. A leg is free to do isometric exercises even with the pillow in place. The body anchor member reaches under the patient's hips and allows the patient to adjust the support for his own comfort. This allows for lightened workloads for nurses and alleviates prolonged waiting for patients. When the pillow is sold as a disposable unit, patients will be able to enjoy use at home after being discharged from the hospital. The pillow can be packaged flat for hospital convenience. Readily available sheepskins or toweling can be used to pad the pillow.

Having thus described the preferred embodiments of the present invention, it is a principal object hereof to provide an inflatable multi-purpose medical support pillow.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
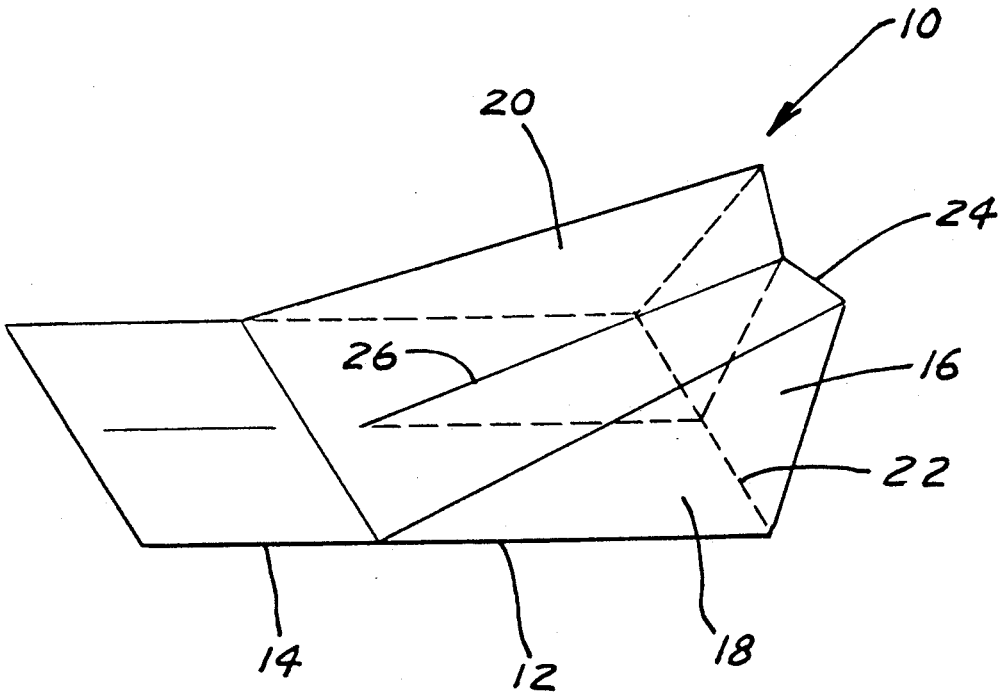
FIG. 1 illustrates a perspective view of an inflatable multi-purpose medical support pillow, the present invention.

FIG. 1 illustrates a perspective view of an inflatable multi-purpose medical support pillow 10 including a base 12 and a body anchor 14 secured thereto. The inflatable multi-purpose medical support pillow 10 further includes a back 16, right side 18, a left side 20, end 22, and a top 24. An internal center support 28 substantially secures between the base 12, end 22 and top 24. The center support 28 is open at one end to allow for air passage, or in the alternative, can include a plurality of holes for air passage. Based upon the physical dimensions of the components 16–24, a groove 26 is formed in the top 24. The seams of the pillow can be heat sealed or otherwise suitably secured. The pillow is made of a suitable polymer material.

Figure 2:
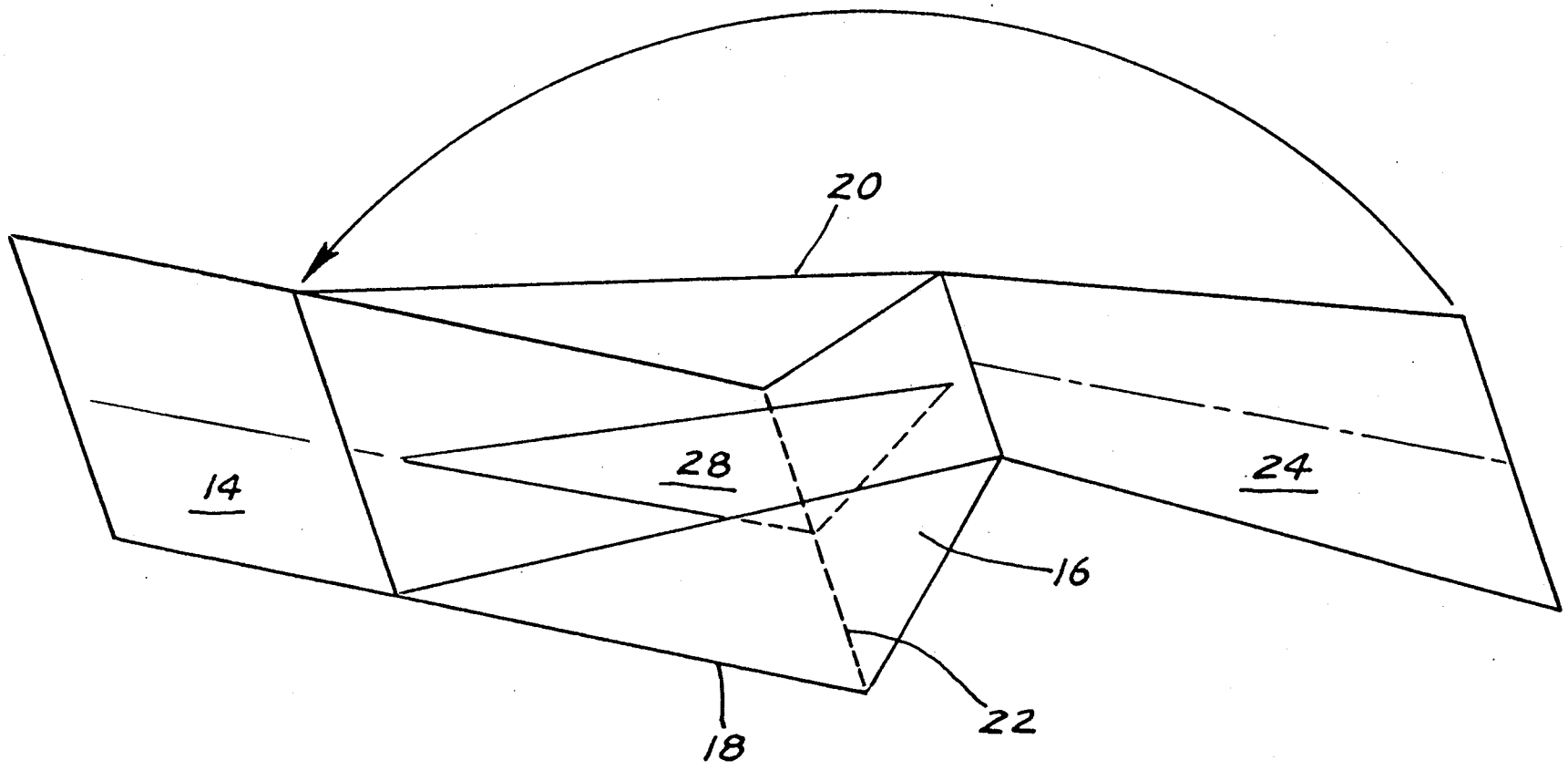
FIG. 2 illustrates a sectional view of the inflatable multi-purpose medical support pillow.

FIG. 2 illustrates a sectional view of the inflatable multi-purpose medical support pillow 10 where all numerals correspond to those elements previously described. Particularly illustrated is the internal center support 28.

Figure 3A:
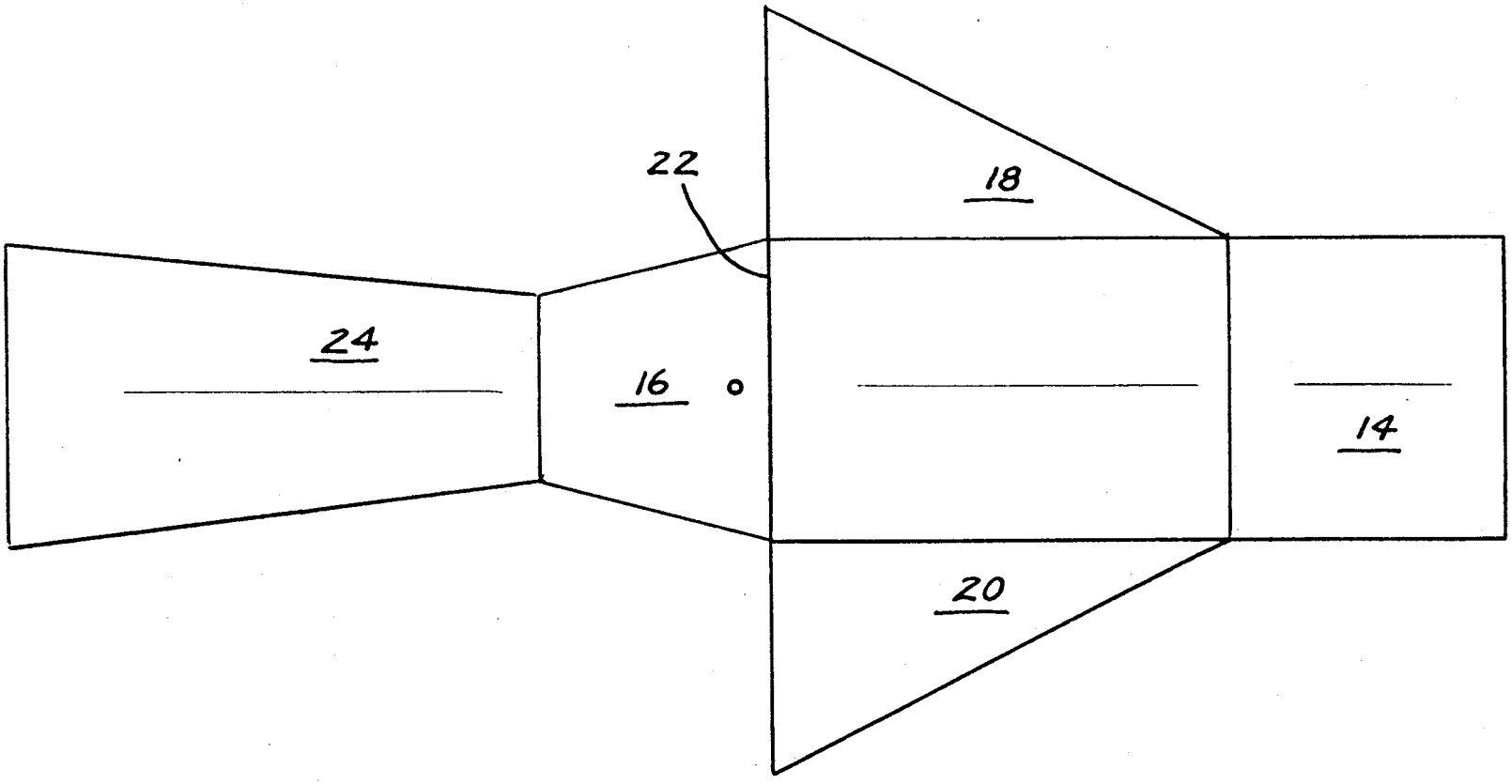
FIG. 3A illustrates a plan view of the elements.

FIG. 3A illustrates a plan view of the elements 14–24.

Figure 3B:
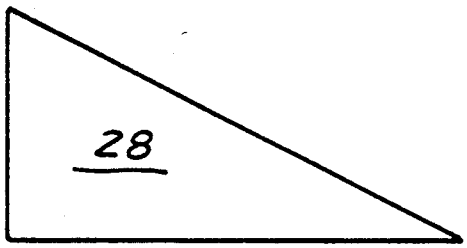
FIG. 3B illustrates a plan view of the internal center support.

FIG. 3B illustrates a plan view of the internal center support 28.

Figure 4:
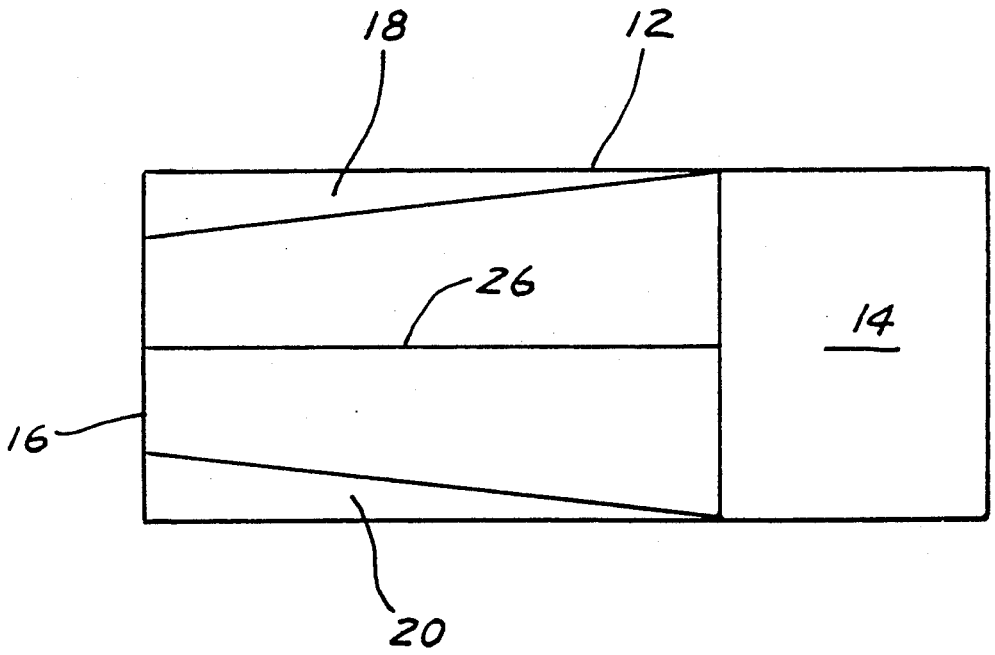
FIG. 4 illustrates a top view of the inflatable multi-purpose medical support pillow.

FIG. 4 illustrates a top view of the inflatable multi-purpose medical support pillow 10.

Figure 5:
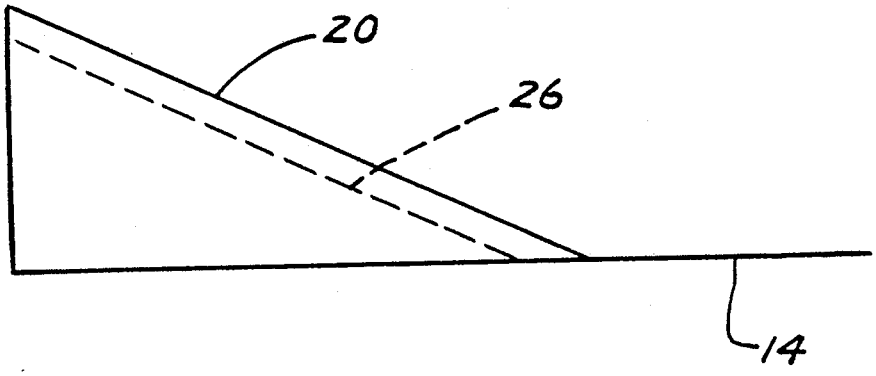
FIG. 5 illustrates a side view of the inflatable multi-purpose medical support pillow.

FIG. 5 illustrates a side view of the inflatable multi-purpose medical support pillow 10.

Figure 6:
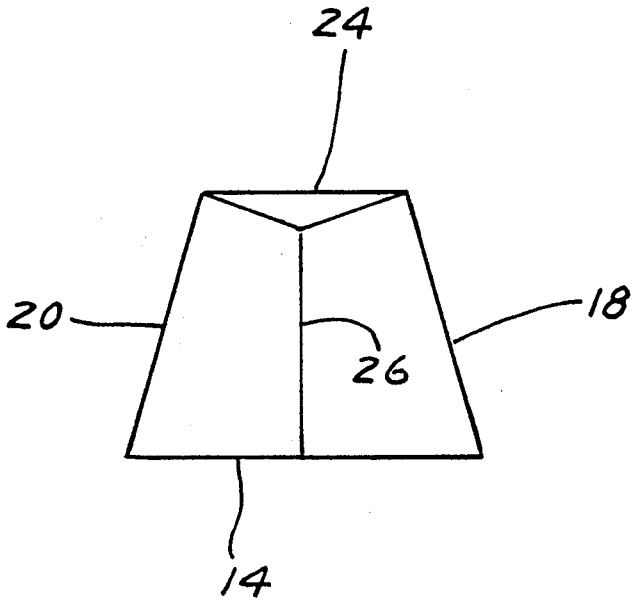
FIG. 6 illustrates a front view of the inflatable multi-purpose medical support pillow; and, FIG. 7 illustrates a back view of the inflatable multi-purpose medical support pillow.

FIG. 6 illustrates a front view of the inflatable multi-purpose medical support pillow 10.

Figure 7:
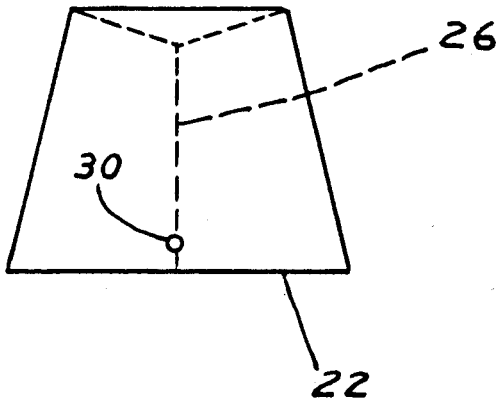

FIG. 7 illustrates a back view of the inflatable multi-purpose medical support pillow 10 including an air valve 30 which is molded into the end of the inflatable multi-purpose medical support pillow 10. The air valve can be situated anywhere on the pillow 10. The air valve 30 is similar to that utilized on air mattresses or floatable air toys, and preferably the type which after inflation pushes into the pillow, providing for a substantially flush surface.

MODE OF OPERATION

This invention is a multi-purpose inflatable multi-purpose air support. The inflatable multi-purpose medical support pillow can be used in different positions to facilitate different uses. The body anchor allows the patient to make adjustments in the pillow's position and also aids in stabilizing the pillow.

The inflatable multi-purpose medical support pillow can be positioned with the grooved side up, the body anchor under the hips, and the tallest end under the ankle. In this position the inflatable multi-purpose medical support pillow is an effective knee or ankle support. The deep groove cradles the leg giving much needed support and comfort while the extremity is elevated. The pillow does not allow for hyperextension of the knee. The inflatable multi-purpose medical support pillow does not interfere with isometric exercises.

With the deeply grooved side up, the body anchor under the shoulders, and the tallest end under the hand, the inflatable multi-purpose medical support pillow is an effective upper extremity elevator. This position does not interfere with exercises of the extremity.

The inflatable multi-purpose medical support pillow is also an effective aid in treatment of respiratory conditions. With the body anchor under the hips, shallow grooved side up, and tallest end under the head, the inflatable multi-purpose medical support pillow is an effective upper back support which positions the lungs in such a way as to ease breathing. With the deeply grooved side down and the patient laying on the pillow so that his hips are positioned over the tallest end of the pillow and the head turned to one side over the lowest end of the pillow, the inflatable multi-purpose medical support pillow is an effective tool for use in pulmonary drainage. It is conceivable that the pillow could be used in the previous position as an aid in breathing, then turned when time for pulmonary drainage, then turned again as an aid in breathing. This would alleviate the bunglesome methods now in use.

When the inflatable multi-purpose medical support pillow is turned on the side with the narrow point between the upper thighs and the wide area extending down to or past the ankles, it is useful for hip abduction.

With the deeply grooved side down, the tallest end under the knees, and the narrow point extending under the ankles, the inflatable multi-purpose medical support pillow is a comfortable support for spinal surgery patients.

Hiatial hernia patents often sleep with the head of their bed elevated for comfort. This is also true of patients suffering from esophageal reflux conditions. Unfortunately, if one is sleeping in the bed with this patient, one must also sleep in this position. The inflatable multi-purpose medical support pillow can be positioned with the deeply grooved side down, the tallest section under the head, and the narrow point extending down toward the lower back. This allows for comfortable elevation of the patient without interfering with the rest of the partner.

Since the inflatable multi-purpose medical support pillow is waterproof, it can be used in whirlpools. Some patients who have difficulty breathing while in the Hubbard tank could find it easier to breathe with their head elevated on the inflatable multi-purpose medical support pillow. There are times that a patient would benefit from a whirlpool, but the necessity of keeping an extremity dry negates the possibility of a whirlpool treatment. The inflatable multi-purpose medical support pillow could be positioned under the proper extremity of the body anchor in position according to extremity and the patient could receive the whirlpool treatment while the extremity remains dry.

Mastectomy patients need support under their arm after surgery. The inflatable multi-purpose medical support pillow can comfortably provide that support.

The inflatable multi-purpose medical support pillow has two different covers. The first is made of a cotton knit for patient who will be using the inflatable multi-purpose medical support pillow on a short-term use. The second is made of man-made sheep skin for long-term users of the inflatable multi-purpose medical support pillow. Both covers are made to completely encase the pillow from the end of the body anchor to the tallest end. The cover slips on like a pillow case and fastens with Velcro at the tallest end.

The inflatable multi-purpose medical support pillow will support and elevate the knee in the Trendelenburg position. The pillow will not interfere with isometric exercises. The inflatable multi-purpose medical support pillow is a comfortable but firm support for hip abduction. The inflatable multi-purpose medical support pillow is a useful support for positioning with spinal surgery patients. The inflatable multi-purpose medical support pillow is also effective in upper extremity elevation for CVA patients. The inflatable multi-purpose medical support pillow gives effective upper back support and aids in upper breathing. The inflatable multi-purpose medical support pillow is useful in promoting pulmonary drainage.

The inflatable multi-purpose medical support pillow can utilize a pillow slip which is 54–60 inches long and 30–40 inches wide. The pillow slip is made either of man-made sheepskin or cotton-knit. The cotton-knit pillow slip is made of a tubular cotton-knit fabric seamed on one end and open on the other. The open end is hemmed with a 1 inch hem. The open end fastens with three Velcro fasteners. The sheepskin pillow slip is seamed at one end and down both sides. The open end is hemmed with a 1 inch hem. The open end fastens with three Velcro fasteners. In use, the pillow is inserted through the open end of the pillow slip. The pillow slip is fastened with the Velcro fasteners at the tall end of the pillow. The pillow may be inflated and deflated for patient comfort without moving the patient off the pillow.

Various modifications can be made to the present invention without departing from the apparent scope hereof.

I claim:

1. Inflatable multi-purpose medical support pillow comprising:

a. a base member including a body anchor secured to one end of the base member;

b. an end member of a trapezoidal shape secured to another end of said bottom member;

c. a top of a trapezoidal shape and having a common edge to an edge of said end member of a trapezoidal shape;

d. opposing side members of a triangle shape secured to sides of said base member for engaging said end member and said top member; and, e. an internal center support of triangular shape secured between mid-sections of said base member, said end member and said top member, said internal support being of a lessor area than any one of said side members for supporting and defining a groove along a surface of said top member whereby said groove supports and centers a body member about said groove thereby forming a crease in said pillow and supporting a body member.

2. Pillow of claim 1 wherein said body anchor is 2–18 inches by 20–36 inches.

3. Pillow of claim 1 wherein said base member is 30 inches by 20–36 inches.

4. Pillow of claim 1 wherein said end member is about 15 inches tall by 20–36 inches wide.

5. Pillow of claim 1 wherein said top is 34 inches by 20 inches.

6. Pillow of claim 1 wherein said right sides and left sides are 16 inches by 34 inches by 30 inches.

7. Pillow of claim 1 wherein said center support is a right angle 26 inches by 13 inches.

8. Pillow of claim 1 including an air valve in said end.

9. Pillow of claim 1 including at least one air passage means in said center support.

* * * * *